US008123035B2

(12) United States Patent
Won

(10) Patent No.: US 8,123,035 B2
(45) Date of Patent: Feb. 28, 2012

(54) SHOCK-ABSORBING PACKAGE

(75) Inventor: Jin Sik Won, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/872,053

(22) Filed: Aug. 31, 2010

(65) Prior Publication Data

US 2011/0049001 A1 Mar. 3, 2011

(30) Foreign Application Priority Data

Aug. 31, 2009 (KR) ..... 10-2009-0080979

(51) Int. Cl.
*B65D 81/02* (2006.01)
*B65D 85/00* (2006.01)

(52) U.S. Cl. ..... 206/522; 383/3; 383/101

(58) Field of Classification Search ..... 206/522, 206/521.9; 229/309, 92.7, 87.02, 92.3, 927–929, 229/76, 77, 78.2, 82, 84; 220/203.22, 712; 383/3, 23, 31, 26, 51, 47, 61.2, 61.5, 74, 383/98, 92, 88, 89–91, 93, 96, 77, 69, 63, 383/30, 205, 86, 86.1, 200, 100, 101
See application file for complete search history.

(56) References Cited

U.S. PATENT DOCUMENTS

| | | | | |
|---|---|---|---|---|
| 4,765,485 | A * | 8/1988 | Perkins | 229/315 |
| 2002/0064319 | A1 * | 5/2002 | Tanaka et al. | 383/3 |
| 2005/0109656 | A1 * | 5/2005 | Ishizaki | 206/522 |
| 2009/0127153 | A1 * | 5/2009 | Kim | 206/522 |

* cited by examiner

*Primary Examiner* — Mickey Yu
*Assistant Examiner* — Rafael Ortiz
(74) *Attorney, Agent, or Firm* — Stanzione & Kim, LLP

(57) ABSTRACT

A shock-absorbing package is disclosed. The shock-absorbing package includes a package body defining a pocket into which the object being packed is received and a pocket opening. A cover is provided to close the pocket opening, and includes a cover air pocket for added protection against shock and for ensuring the pocket opening to remain closed. The cover air pocket is inserted into a hole provided on the package body in such a manner the cover air pocket when inflated with air remains in engagement with the hole so as to keep the cover in the closed position. The object may be taken out from the package by deflating the cover air pocket thus allowing the cover to be released from the closed position.

18 Claims, 4 Drawing Sheets

SHOCK-ABSORBING PACKAGE

CROSS-REFERENCE TO RELATED APPLICATION(S)

This application claims the benefit of Korean Patent Application No. 10-2009-0080979, filed on Aug. 31, 2009 in the Korean Intellectual Property Office, the disclosure of which is incorporated herein by reference in its entirety.

TECHNICAL FIELD

Aspects of the present disclosure relate generally to a shock-absorbing packing material for protecting objects packed therein from external shock.

BACKGROUND OF RELATED ART

Packages of various materials and configurations of differing degrees of efficacy are in everyday use by shippers and manufactures alike during transporting, distribution and/or storage of goods to protect the goods against damages resulting from shock, temperature, humidity and/or the like. One type of such package is an air-injected shock-absorbing package, which is gaining a recent popularity due to its light weight and the shock absorbing characteristics of air. Such an air-injected shock-absorbing package includes a plurality of air pockets filled with air to prevent or dampen the transmission of externally received shock to an object packed in the package.

The air-injected shock-absorbing package includes a package body typically in the shape of a pocket, sleeve or an envelope, defining at least a partial enclosure into which the object being packed is received and an entrance opening through which the object is received into such partial enclosure. The package body also includes a plurality of air pockets that can be inflated by an injection of air.

In a conventional air-injected shock-absorbing package of the above described structure, once the object is received in the package through the entrance opening, in order to complete the packaging of the object, the entrance opening is sealed or closed at least partially to prevent the object from falling out, for example, by boding, e.g., thermally fused, together the sides of the package bodies adjacent the entrance opening.

SUMMARY OF DISCLOSURE

In accordance with an aspect of the present disclosure, shock-absorbing package may be provided to include a body defining a pocket and a pocket opening through which to receive an object into the pocket, a cover formed on one side of the pocket opening in such a manner capable of covering the pocket opening, a penetration hole formed on the other side of the pocket opening in such a manner capable of receiving therethrough at least in part the cover and a cover air pocket formed on the cover. The cover air pocket may be inflatable with air into an inflated volume that is larger than a deflated volume the cover air pocket has when it is deflated.

The cover air pocket may have its length extending substantially parallel to a lengthwise direction of the penetration hole. When injected with air, the cover air pocket may have thickness substantially greater than the width of the penetration hole.

The penetration hole may have a length that extends parallel to the pocket opening. The cover may include a reduced portion having a first width that is smaller than the length of the penetration hole and a locking portion having a second width that is lager than the length of the penetration hole. The locking portion may be passable through the penetration hole so as to be in an engaged contact with portions of the body proximate to the penetration hole. The cover air pocket may be formed on the locking portion of the cover.

The body may comprise a plurality of body air pockets each capable of being filled with air.

The body may further comprises an inlet through which air is received into the body, a main injection path configured to distribute the air received through the inlet to the plurality of body air pockets and to the cover air pocket and a plurality of sub injection paths each connected to the main injection path at one end thereof and to a corresponding one of the plurality of body air pockets and the cover air pocket at the other end thereof.

The locking portion may comprise a notch facilitating tearing of the locking portion.

According to another aspect of the present disclosure, a shock-absorbing package may be provided to include a body defining a pocket and a pocket opening for receiving therethrough an object into the pocket, a cover formed on the body to extend on one side of the pocket opening in such a manner capable of covering the pocket opening and a cover air pocket formed on the cover, the cover air pocket being inflatable with air so as to absorb at least partially a shock received by the cover.

The body may comprise a penetration hole formed on a side of the pocket opening opposite the cover in such a manner capable of receiving therethrough at least a portion of the cover. The cover may comprise a reduced portion having a first width smaller than the length of the penetration hole and a locking portion having a second width lager than the length of the penetration hole. The locking portion may be passable through the penetration hole so as to be in an engaged contact with portions of the body proximate to the penetration hole. The cover air pocket may be formed on the locking portion.

The cover air pocket may have its length extending substantially parallel to the length of the penetration hole. When injected with air, the cover air pocket may have a thickness substantially greater than a width of the penetration hole.

The locking portion may comprise a notch facilitating tearing of the locking portion.

According to yet another aspect of the present disclosure, there may be provided a package for packing an object therein, which may include a package body defining a sleeve for receiving therein the object to be packed, the sleeve being open at at least one end thereof, a cover flap extending from the sleeve in such a manner capable of covering an opening of the sleeve and a cover air pocket formed on the cover flap. The cover air pocket may be inflatable with air.

The package may further comprise a hole formed on the package body. The hole may be configured to receive a portion of the cover flap including the cover air pocket, and may have a hole width that allows the cover air pocket to pass through the hole when the cover air pocket is deflated, and that does not allow the cover air pocket to pass through the hole when the cover air pocket is inflated with air.

The package body may comprise at least two sheets of film bonded together at select portions thereof, at least some of those other portions of the at least two sheets of films not bonded defining one or more body air pockets inflatable with air.

The sleeve may be formed by folding of the at least two sheets of film that are bonded together at select portions thereof.

The package may further comprise an air inlet through which air is received and an air supply path through which the air received through the air inlet is conveyed to the cover air pocket.

The sleeve may have formed thereon one or more body air pockets inflatable with air. The air supply path may comprise a first air supply path between the air inlet and the one or more body air pockets and a second air supply path between the air inlet and the cover air pocket.

The air inlet may alternatively comprise a first air inlet and a second air inlet. The air supply path may alternatively comprise a first air supply path between the first air inlet and the one or more body air pockets and a second air supply path between the second air inlet and the cover air pocket.

The first air supply path and the second air supply path may not be connected to each other so that there is no air passage between them.

The cover flap may have formed thereon a notch facilitating tearing of the cover flap in such a manner causing the cover air pocket to be deflated.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
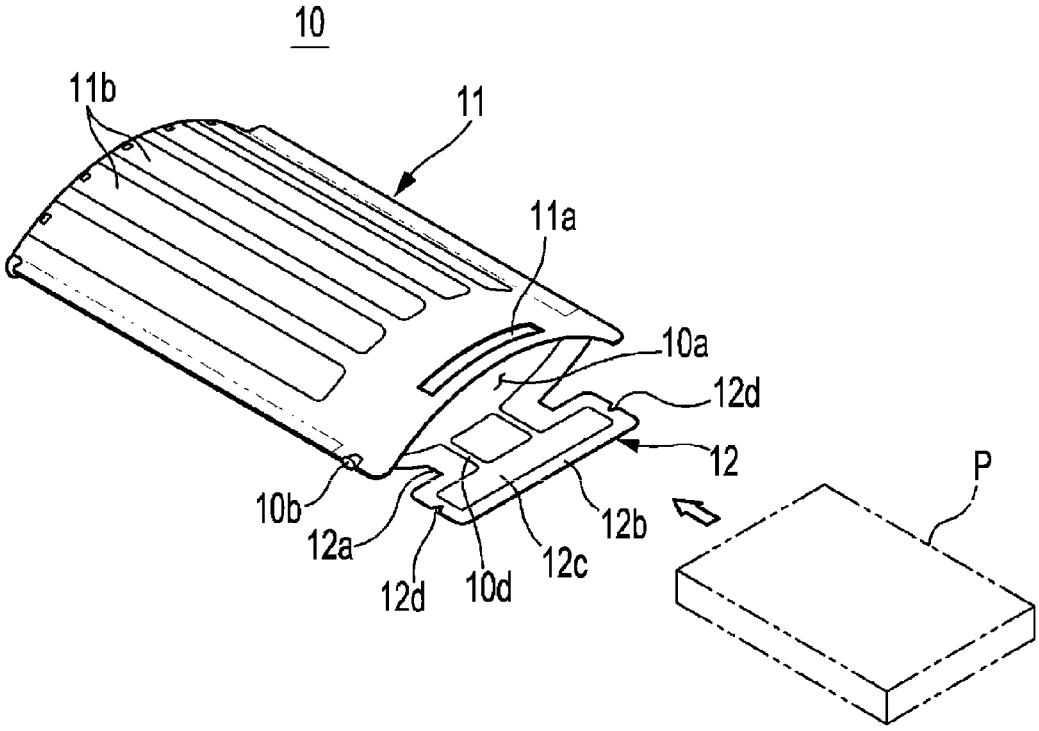
FIG. 1 is a perspective view of a shock-absorbing package according to an embodiment of the present disclosure.

Reference will now be made in detail to embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

Figure 2:
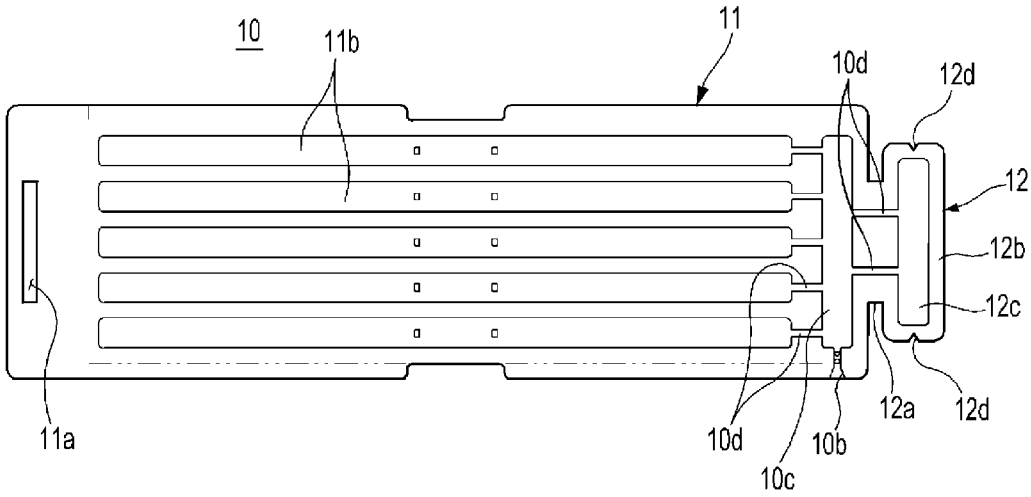
FIG. 2 is a partially assembled plan view of the shock-absorbing packing material according to an embodiment of the present disclosure.

As shown in FIGS. 1 and 2, a shock-absorbing package 10 according to an embodiment of the present disclosure may include a body 11 defining a pocket, sleeve or an envelope shape that provides a receiving part 10*a* for receiving the object being packed and a cover or flap 12 integrally formed with the body 11 to extended from one side of the body 11 near an entrance of the receiving part 10*a* in such a manner capable of closing the entrance of the receiving part 10*a*.

A penetration hole 11*a* may be formed on the other side of the entrance of the receiving part 10*a*, in the vicinity of the entrance. According to an embodiment, the penetration hole 11 may extend along a direction parallel to the entrance. The cover 12 may include a reduced portion 12*a*, the width of which may be smaller than the length of the penetration hole 11*a*, and a locking portion 12*b* configured to be capable of passing through the penetration hole 11*a* while having a width that is larger than the length of the penetration hole 11*a* so as to be capable of being engaged with portions of the body 11 around the penetration hole 11*a*. According to an embodiment, the reduced part 12*a* and the locking part 12*b* may be formed integrally with respect to each other.

The body 11 may include a plurality of body air pockets 11*b* that serve to dampen the transmission of externally received shock to the object P received in the receiving part 10*a*. The cover 12 may include one or more cover air pockets 12*c*, which may serve the purposes of dampening the transmission of the external shock received to the entrance of the receiving part 10*a*, and of maintaining the locking part 12*b* in the state of engagement with the portions of the body 11 at the penetration hole 11*a*.

According to an embodiment, the body air pockets 11*b* may have elongated shapes that extend parallel to one another along the body 11, for example, from one end of the body 11 near the entrance of the receiving part 10*a* to the opposite end. The cover air pocket 12*c* may be formed on the locking part 12*b* of the cover 12, for example, to extend along the length direction of the penetration hole 11*a*, and, according to an embodiment, may be arranged to extend perpendicular to the body air pockets 11*b*. The cover air pocket 12*c* may be designed to be capable of being inflated to a thickness relatively larger in comparison to the width of the penetration hole 11*a* so that the cover air pocket 12*c* when inflated cannot pass through the penetration hole 11*a*.

According to an embodiment, one or more V-shaped notches 12*d* may further be provided at one or both sides of the locking part 12*b* of the cover 12 so that the locking part 12*b* can be conveniently torn off using the V-shaped notch(es) 12*d* to thereby deflate the cover air pocket 12*c*.

The shock-absorbing package 10 may further include an air inlet 10*b* through which air may be injected into, and be supplied to, the plurality of body air pockets 11*b* and the cover air pocket 12*c*. The shock-absorbing package 10 may further include a main injection path 10*c* (shown in FIG. 2) and a plurality of sub injection paths 10*d*. The air injected through the inlet 10*b* is distributes the to the body air pockets 11*b* and the cover air pocket 12*c* via the main injection path 10*c*. Each of the plurality of sub injection paths 10*d* is connected to the main injection path 10*c* at one end thereof, and to each corresponding one of the plurality of body air pockets 11*b* or the cover air pocket 12*c* at the other end thereof, such that the air injected into the main injection path 10*c* is distributed to the body air pockets 11*b* and to the cover air pocket 12*c*. Although not shown, the sub injection paths 10*d* may each be equipped with a valve to prevent the air from flowing back from the body air pockets 11*b* and the cover air pocket 12*c* toward the main injection path 10*c*.

The shock-absorbing package 10 including the body air pockets 11*b*, the cover air pocket 12*c*, the inlet 10*b*, the main injection path 10*c* and the sub injection path 10*d* may be formed by binding, for example, through thermally fusing selective portions of a plurality of film members made of resin. For example, the cover 12 may be formed at one end of a plurality of film members bonded to each other at select portions thereof while the penetration hole 11*a* may be formed at the other end as shown in FIG. 2. The film members may then be folded at the middle thereof. The folded halves may be bonded, for example, through thermal fusion, at both side ends to produce the shock-absorbing package 10 that includes the receiving part 10*a* between the film member halves.

In order to pack the object P in the shock-absorbing package 10, in the initial state in which the body air pockets 11*b* and the cover air pocket 12*c* are not injected with air, the entrance of the receiving part 10*a* of the shock-absorbing package 10 may be widened as illustrated in FIG. 1 to receive therethrough the object P in the receiving part 10*a*.

Figure 3:
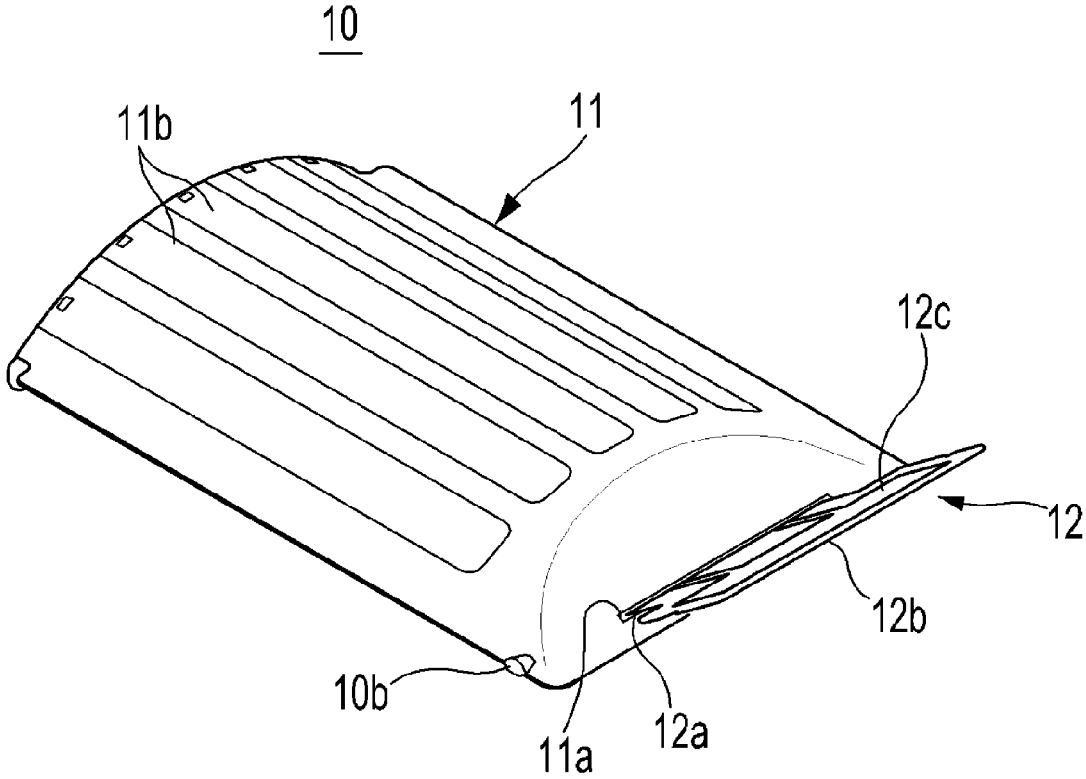
FIG. 3 and FIG. 4 are perspective views showing the processes of packing an object using the shock-absorbing package according to an embodiment of the present disclosure.

After the object P is received in the receiving part 10*a* through the widened entrance of the receiving part 10*a*, the locking part 12*b* of the cover 12 may be passed through the penetration hole 11*a*, and may be supported by portions of the body 11 around the penetration hole 11*a* so that the cover 12 closes the entrance of the receiving part 10*a* as shown in FIG. 3. The locking part 12*b* in its deflated state may be inserted into and pass through the penetration hole 11*a* with a relative ease as the shape thereof can be transformed such as, for example, by folding, bending, stretching, etc., so as to be passable through the penetration hole 11*a*, since the shock-absorbing package 10, including the locking part 12*b*, may be film(s), such as, for example, made of resin. Therefore, the locking part 12*b* can pass through the penetration hole 11*a*, and can returned to the shape allowing engaged contact with the portions of the body 11 near the penetration hole 11*a*.

Figure 4:
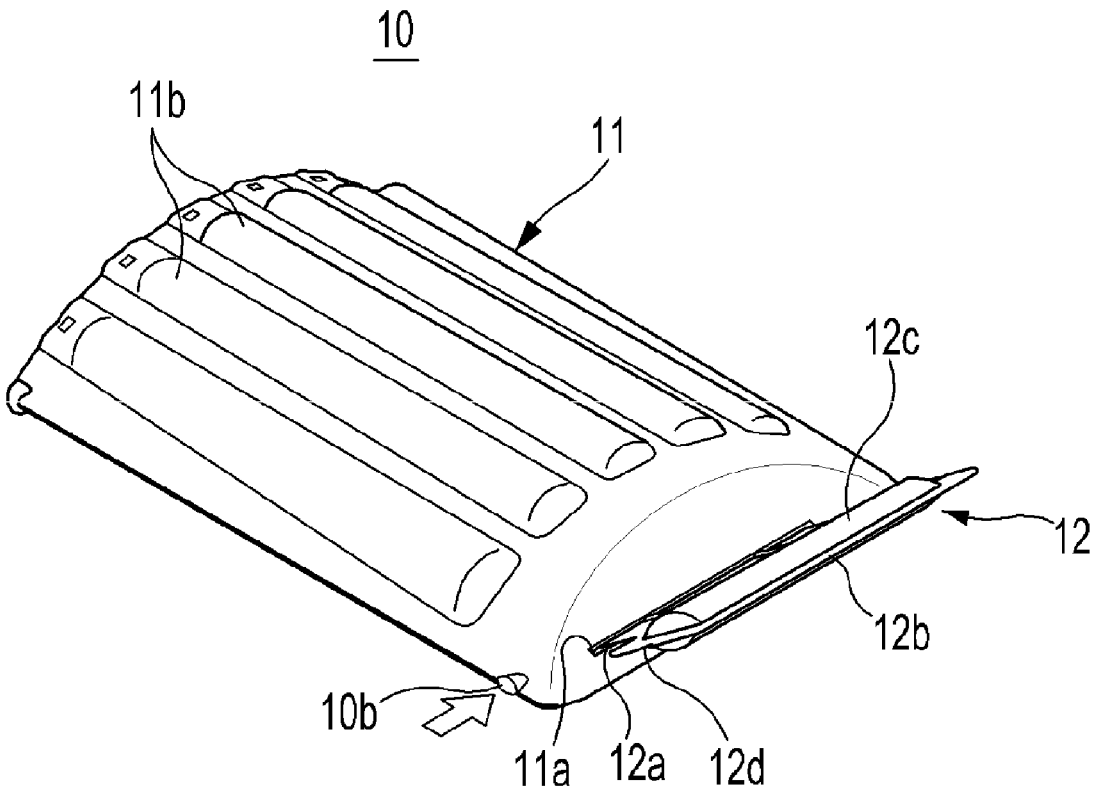

When air is injected through the inlet 10*b* with the locking part 12*b* of the cover 12 in engaged contact with the body 11 near the penetration hole 11*a* as shown in FIG. 4, the injected air is supplied to the plurality of air pockets 11*b* and the cover air pocket 12*c* through the main injection path 10*c* and the plurality of sub injection paths 10*d*. Accordingly, the body air pockets 11*b* and the cover air pocket 12*c* are inflated by the air into the inflated form having an almost circular sectional shape. The thickness of the inflated cover air pocket 12*c* in particular becomes substantially greater than the width of the penetration hole 11*a*.

The locking part 12*b* in such increased thickness state when the cover air pocket 12*c* is inflated cannot pass through the penetration hole 11*a*, thereby maintaining the cover 12 in the state that it closes the entrance of the receiving part 10*a*.

Moreover, since the air charging the body air pockets 11*b* and the cover air pocket 12*c* is compressible, transmission of shock may be effectively absorbed by the air, greatly reducing the amount of the externally received shock transmitted to the object P in the receiving part 10*b*. Shock received to the entrance of the receiving part 10*a* may be absorbed by the cover air pocket 12*c* whereas shock to the other parts may be absorbed by the body air pockets 11*b*.

When the object P needs to be taken out from the receiving part 10*a* of the shock-absorbing package 10, the locking part 12*b* may be torn off using the notches 12*d*, thereby deflating the cover air pocket 12*c*. Since the thickness of the locking part 12*b* is reduced due to the deflation of the cover air pocket 12*c*, the locking part 12*b* can be shaped to escape the penetration hole 11*a* with a relative ease, allowing the cover 12 to open the entrance of the receiving part 10*a*, and thus allowing the removal of the object P from the receiving part 10*a*.

Although embodiments in which the body air pockets 11*b* and the cover air pocket 12*c* are both supplied with air through one main injection path 10*c* has been described above, according to alternative embodiments, the cover air pocket 12*c* may be injected with air through air supply path(s) separate from the body air pockets 11*b*.

A shock-absorbing package according to one or more aspects of the present disclosure provides the closure of the package using a cover air pocket is provided to the cover passable through a penetration hole provided in the package. By inflating the cover air pocket to a larger volume, the cover stays closed. The shock-absorbing package according to one or more aspects of the present disclosure may be re-open by deflating the cover air pocket.

The cover air pocket formed on the cover may provide an additional protection against shock to the portion of the package at the receiving entrance of the package.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A shock-absorbing package, comprising:

a body defining a pocket and a pocket opening through which to receive an object into the pocket;

a cover formed on one side of the pocket opening in such a manner capable of covering the pocket opening;

a penetration hole formed on the other side of the pocket opening in such a manner capable of receiving therethrough at least in part the cover; and a cover air pocket formed on the cover, the cover air pocket being inflatable with air into an inflated volume that is larger than a deflated volume the cover air pocket has when it is deflated; and the penetration hole being configured to receive the part of the cover including the cover air pocket, the penetration hole having a hole width that allows the cover air pocket to pass through the penetration hole when the cover air pocket is deflated, and that does not allow the cover air pocket to pass through the penetration hole when the cover air pocket is inflated with air.

2. The shock-absorbing package according to claim 1, wherein the cover air pocket has its length extending substantially parallel to a lengthwise direction of the penetration hole, and, when injected with air, has a thickness substantially greater than a width of the penetration hole.

3. The shock-absorbing package according to claim 1, wherein the penetration hole has a length that extends parallel to the pocket opening, wherein the cover includes a reduced portion having a first width smaller than the length of the penetration hole and a locking portion having a second width larger than the length of the penetration hole, the locking portion being passable through the penetration hole so as to be in an engaged contact with portions of the body proximate to the penetration hole, and wherein the cover air pocket is formed on the locking portion of the cover.

4. The shock-absorbing package according to claim 1, wherein the body comprises a plurality of body air pockets each capable of being filled with air.

5. The shock-absorbing package according to claim 4, wherein the body further comprises:

an inlet through which air is received into the body;

a main injection path configured to distribute the air received through the inlet to the plurality of body air pockets and to the cover air pocket; and a plurality of sub injection paths each connected to the main injection path at one end thereof and to a corresponding one of the plurality of body air pockets and the cover air pocket at the other end thereof.

6. The shock-absorbing package according to claim 3, wherein the locking portion comprises a notch facilitating tearing of the locking portion.

7. A shock-absorbing package, comprising:

a body defining a pocket and a pocket opening for receiving therethrough an object into the pocket;

a cover formed on the body to extend on one side of the pocket opening in such a manner capable of covering the pocket opening; and a cover air pocket formed on the cover, the cover air pocket being inflatable with air so as to absorb at least partially a shock received by the cover, wherein the body comprises a penetration hole formed on a side of the pocket opening opposite the cover in such a manner capable of receiving therethrough at least a portion of the cover, wherein the cover comprises a reduced portion having a first width smaller than a length of the penetration hole and a locking portion having a second width larger than the length of the penetration hole, the locking portion being passable through the penetration hole so as to be in an engaged contact with portions of the body proximate to the penetration hole, and wherein the cover air pocket is formed on the locking portion.

8. The shock-absorbing package according to claim 7, wherein the cover air pocket has its length extending substantially parallel to the length of the penetration hole, and, when injected with air, has a thickness substantially greater than a width of the penetration hole.

9. The shock-absorbing package according to claim 7, wherein the locking portion comprises a notch facilitating tearing of the locking portion.

10. A package for packing an object therein, comprising:

a package body defining a sleeve for receiving therein the object to be packed, the sleeve being open at least one end thereof;

a cover flap extending from the sleeve in such a manner capable of covering an opening of the sleeve;

a cover air pocket formed on the cover flap, the cover air pocket being inflatable with air; and a hole formed on the package body, the hole being configured to receive a portion of the cover flap including the cover air pocket, the hole having a hole width that allows the cover air pocket to pass through the hole when the cover air pocket is deflated, and that does not allow the cover air pocket to pass through the hole when the cover air pocket is inflated with air.

11. The package of claim 10, wherein the package body comprises at least two sheets of film bonded together at select portions thereof, at least some of those other portions of the at least two sheets of films not bonded defining one or more body air pockets inflatable with air.

12. The package of claim 11, wherein the sleeve is formed by folding of the at least two sheets of film that are bonded together at select portions thereof.

13. The package of claim 11, further comprising an air inlet through which air is received into the package body and air supply paths through which the air received through the air inlet is conveyed to each of the one or more body air pockets.

14. The package of claim 11, further comprising an air inlet through which air is received and an air supply path through which the air received through the air inlet is conveyed to the cover air pocket.

15. The package of claim 14, wherein the sleeve may have formed thereon one or more body air pockets inflatable with air, and wherein the air supply path comprises a first air supply path between the air inlet and the one or more body air pockets and a second air supply path between the air inlet and the cover air pocket.

16. The package of claim 14, wherein the sleeve may have formed thereon one or more body air pockets inflatable with air, wherein the air inlet comprises a first air inlet and a second air inlet, and wherein the air supply path comprises a first air supply path between the first air inlet and the one or more body air pockets and a second air supply path between the second air inlet and the cover air pocket.

17. The package of claim 16, wherein the first air supply path and the second air supply path are not connected so that there is no air passage therebetween.

18. The package of claim 10, wherein the cover flap has formed thereon a notch facilitating tearing of the cover flap in such a manner causing the air inflatable pocket to be deflated.

* * * * *